United States Patent [19]

Gettig

[11] 4,171,470

[45] Oct. 16, 1979

[54] MULTI-POLE SWITCH

[76] Inventor: William A. Gettig, Linnwood, Box 417, Millheim, Pa. 16854

[21] Appl. No.: 927,159

[22] Filed: Jul. 24, 1978

[51] Int. Cl.[2] ..... H01H 25/04

[52] U.S. Cl. ..... 200/6 A; 200/17 R; 200/247

[58] Field of Search ..... 200/6 A, 17 R, 18, 283, 200/276, 275, 302, 153 K, 284, 245-247; 74/471 XY

[56] References Cited

U.S. PATENT DOCUMENTS

| | | | |
|---|---|---|---|
| 2,521,489 | 9/1950 | Sorensen | 200/6 A |
| 2,548,103 | 4/1951 | French | 200/247 |
| 3,383,478 | 5/1968 | Mandel | 200/8 R |
| 3,612,801 | 10/1971 | Elliott et al. | 200/302 |
| 3,828,148 | 8/1974 | Roeser | 200/246 X |

FOREIGN PATENT DOCUMENTS

| | | | |
|---|---|---|---|
| 463581 | 7/1928 | Fed. Rep. of Germany | 200/6 A |
| 518116 | 2/1940 | United Kingdom | 200/6 A |
| 789285 | 1/1958 | United Kingdom | 200/6 A |

*Primary Examiner*—James R. Scott
*Attorney, Agent, or Firm*—Emory L. Groff, Jr.

[57] ABSTRACT

A multi-pole switch includes a wobble stick type actuator provided with a contactor engaging the free end portions of a plurality of displaceable resilient inner pin contacts having their base portions fixedly mounted in a support member. A plurality of stationary pin contacts are disposed radially outside and adjacent said displaceable pin contacts. A guide member adjacent the contactor includes a plurality of radially extending slots therethrough each housing a portion of one of the displaceable pin contacts and one of the stationary pin contacts in a normally spaced apart manner. A biasing element normally maintains the contactor in a central, neutral position whereby, upon deflection of the actuator the contactor is radially displaced and correspondingly displaces a selected inner pin contact into engagement with its radially adjacent stationary pin contact in the same guide member slot to close a circuit between the engaging contacts.

12 Claims, 5 Drawing Figures

MULTI-POLE SWITCH

BACKGROUND OF THE INVENTION

This invention relates generally to electric switches actuated by manipulation of a joy stick or wobble stick and more particularly, to an improved multi-pole multi-throw switch containing a plurality of stationary pin contacts arranged adjacent a plurality of displaceable pin contacts and includes unique means serving to support and guide the juxtaposed contacts to insure positive make and break interaction therebetween during selected radial displacement of a contactor.

Multi-pole multi-throw joy stick-actuated electric switches are well known and the present invention evolved from an effort to produce a vastly simplied construction which may be readily manufactured from relatively inexpensive components to yield an assembly which is highly reliable in operation and may be easily assembled and disassembled without the need for any tools. The majority of the instant switch components are preferably constructed of any suitable dielectric material such as synthetic resinous plastics which readily lend themselves to formation by injection molding and the cylindrical symmetrical configuration of most of these components allows of a greatly facilitated assembly thereof by an interfitting, sliding fit therebetween.

The present switch is particularly adaptable for use in an environment employing low voltages and low current and the completion of the various circuits is achieved by the selective displacement of pairs of deflectable contacts into engagement with juxtaposed pairs of stationary contacts. Unlike many prior known switch devices, the present invention proposes to employ wire or pin contacts. This feature in its self demands the provision of suitable means to adequately support and guide the plurality of contacts between their make and break positions and accordingly, an important feature of the present switch is the provision of unique means to mount positively guide and support the various wire contacts.

Accordingly, one of the objects of the present invention is to provide an improved multi-pole multi-throw electric switch operated by a joy stick type actuator member.

Another object of the present invention is to provide an improved switch including a plurality of stationary contacts juxtaposed a plurality of displaceable contacts and including a contact guide member serving to support and maintain for controlled radial movement respective pairs of said displaceable contacts.

Still another object of the present invention is to provide an improved switch including a plurality of stationary wire contacts juxtaposed a plurality of displaceable wire contacts with the latter normally engaging a dielectric contactor which is radially deflectable to displace selected ones of the displaceable contacts into engagement with respective juxtaposed stationary contacts.

A further object of the present invention is to provide an improved switch including an outer shell telescopically containing a guide sleeve serving as a back-up support for a plurality of stationary contacts and which further telescopically contains a guide member through which axially pass a plurality of displaceable contacts disposed within slots therein and which are radially displaceable into engagement with the stationary contacts.

With these and other objects in view, which will more readily appear as the nature of the invention is better understood, the invention consists in the novel construction, combination and arrangement of parts hereinafter more fully described, illustrated and claimed.

BRIEF DESCRIPTION OF THE DRAWINGS

A preferred and practical embodiment of the invention is shown in the accompanying drawings, in which.

DESCRIPTION OF THE PREFERRED EMBODIMENT

Figure 1:
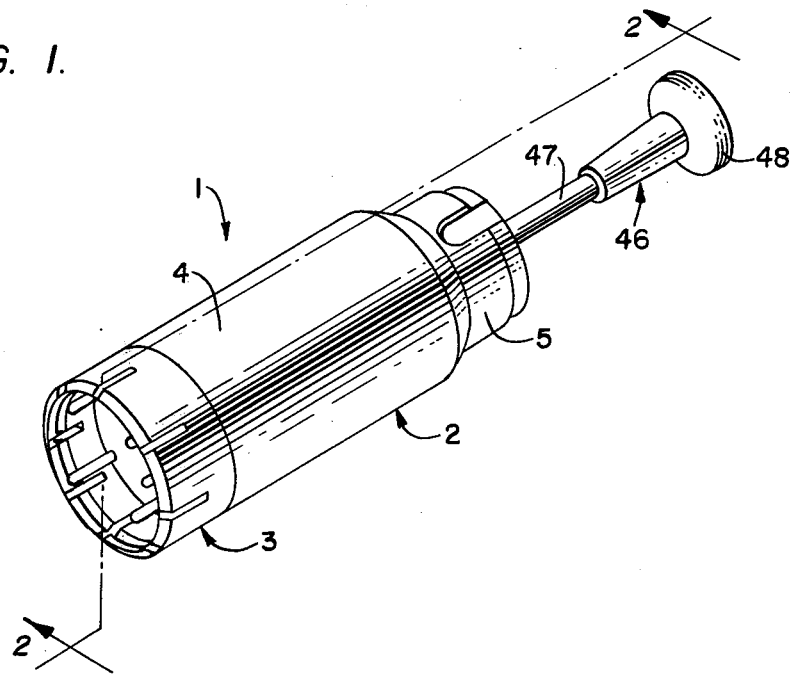
FIG. 1 is a perspective view of the switch according to the present invention.
Figure 2:
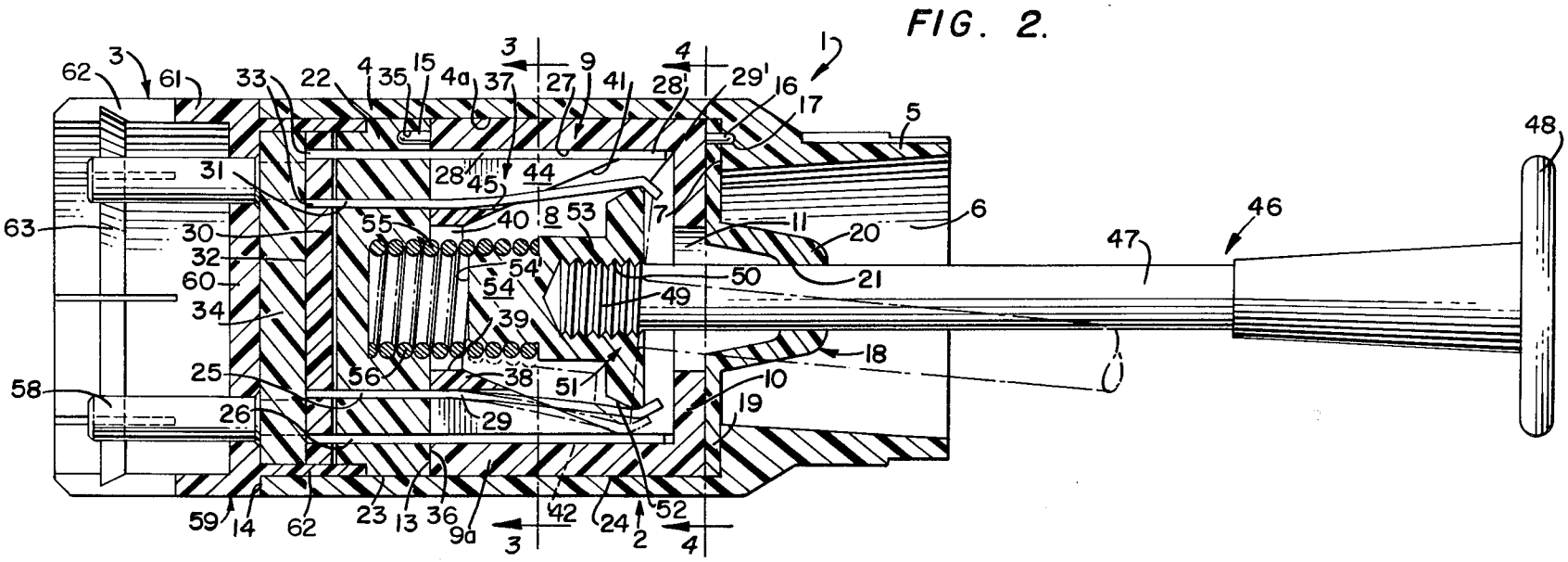
FIG. 2 is an enlarged longitudinal sectional view taken along the line 2—2 of FIG. 1.
Figure 4:
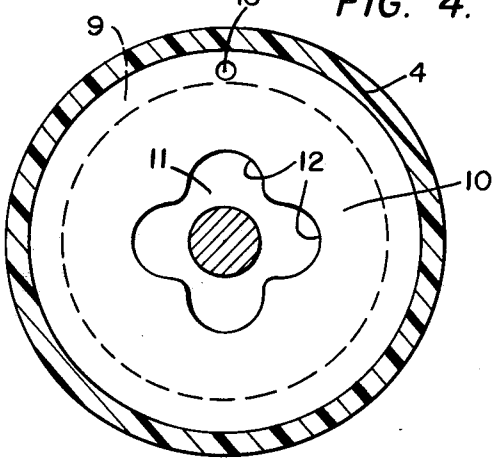
FIG. 4 is a transverse sectional view taken along the line 4—4 of FIG. 2.

Referring now to the drawings, particularly FIGS. 1 and 2, the present invention will be seen to comprise a switch, generally designated 1, comprising as the outermost component a shell 2 and plug assembly 3. The shell 2 is provided with a peripheral body sleeve 4 joined at one end to the plug assembly 3 and terminating in the other end in an integral end sleeve 5. The bore of the end sleeve 5 defines a central throat 6, the inner end of which communicates with a rearwardly directed shoulder 7 joined in turn to the cylindrical inner surface **4*a* of the peripheral body sleeve 4**.

As shown most clearly in FIG. 2 the hollow interior 8 of the peripheral body sleeve 4 of the shell 2 serves to house the majority of the components of the switch 1. Disposed forwardmost within the interior 8 is a guide sleeve 9 having a skirt or side wall **9*a* and an end wall 10 juxtaposed the shell shoulder 7. A central opening 11 is formed in this end wall 10 to provide four equal spaced lobes 12, the purpose of which will become obvious hereinafter. The base 13 of the guide sleeve side wall 9*a* terminates well short of the rear edge 14 of the shell 2 and is provided with one rearwardly projecting pin 15 thereon. A similar type of pin 16 projects forwardly from the guide sleeve end wall 10 and provides a mating fit within a recess 17 formed in the shell shoulder 7. Disposed intermediate the shell end sleeve 5 and guide sleeve end wall 10 is a seal element, generally designated 18, and which includes a cylindrical planar pad 19 joined to a centrally disposed and outwardly projecting collar 20. A suitable hole 21 formed in the seal element pad 19 allows passage of the guide sleeve pin 16** therethrough without restriction.

Disposed longitudinally adjacent to the guide sleeve base 13 is a pin support member 22 having an outer peripheral surface 23 of cylindrical configuration matching in diameter that of the outer periphery 24 of the guide sleeve 9 to provide therewith a close sliding fit juxtaposed the inner surface **4*a* of the shell body sleeve 4. A plurality of pairs of inner and outer contact holes 25 and 26 respectively, are formed through the longitudinal extent of the pin support member 22 with the adjacent pairs of inner holes 25 being centrically disposed and radially aligned relative adjacent pairs of the outer holes 26. Each adjacent pair of respective inner holes 25 and the radially adjacent outer holes 26 are provided in the support member 22 at four equi-spaced points or quadrants in the support member 22. The radial spacing of the outer holes 26 relative the center axis of the support member 22 is quite critical. As will be seen from FIG. 2, the longitudinal axis of the holes 26, if extended toward the end sleeve 5 of the shell 2 will be disposed immediately juxtaposed the inner surface 27 of the guide sleeve side wall 9***a* while the inner holes 25 are disposed at a point intermediate the holes 26 and the center point of the support member 22.

The aforementioned holes 25 and 26 will be seen to serve as support means for the base portions of a plurality of pairs of stationary pin contacts 28 in the outer holes 26 and displaceable pin contacts 29 in the inner holes 25. All of the pins 28 and 29 extend forwardly from the support member 22 to a point juxtaposed the end wall 10 of the guide sleeve 9 on the one hand and additionally extend rearwardly from the support member 22 a short distance into an abuting circuit plate and pin mount 30. The various pins 28 and 29 will be understood to provide a close sliding fit within the respective holes 26 and 25 in the pin support member 22 while the base or terminal portion 31 of the pins disposed within the pin mount 30 are firmly secured thereto in any suitable manner and have their respective distal portions 33 in electrical communication with the rear surface 32 of the pin mount 30. These distal portions 33 may in turn communicate with appropriate printed circuit means (not shown) or otherwise engage appropriate circuit transmitting means carried by the base 34 of the plug assembly 3.

As previously mentioned, the end wall 10 of the guide sleeve 9 is provided with a central opening 11 configured to provide 4 equi-spaced lobes or quadrants 12 therein and it is imperative to insure that during assembly of the instant switch that respective adjacent pairs of stationary pin contacts 28 and displaceable pin contacts 29 are radially aligned with each of the four lobes 12. This alignment is achieved by means of the aforementioned pin 15 projecting rearwardly from the base 13 of the guide sleeve 9 and which cooperates with a mating recess 35 formed in the forward wall 36 of the pin support member 22 as shown in FIG. 2 of the drawings.

Figure 5:
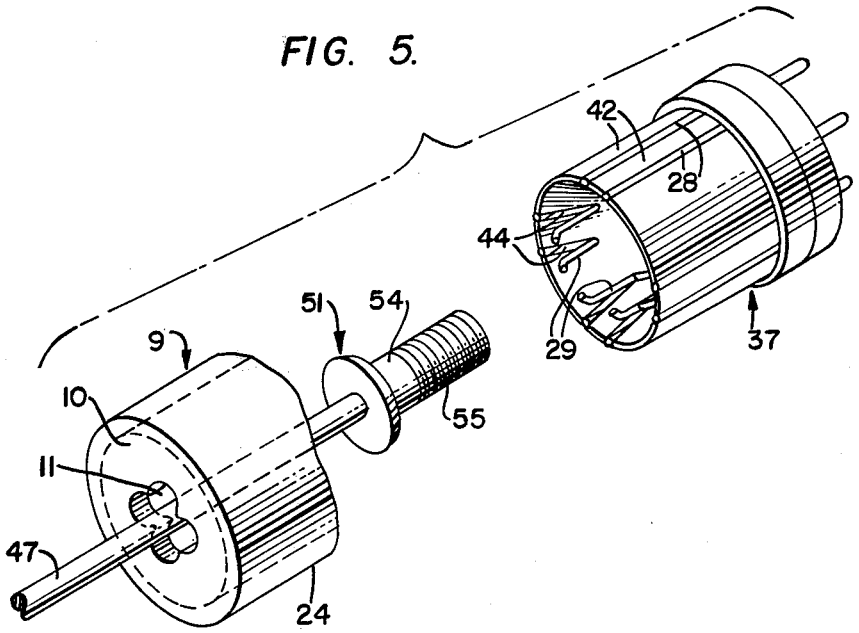
FIG. 5 is an exploded perspective view of the switch illustrated in FIG. 1 with the outer-most shell member removed.
Figure 3:
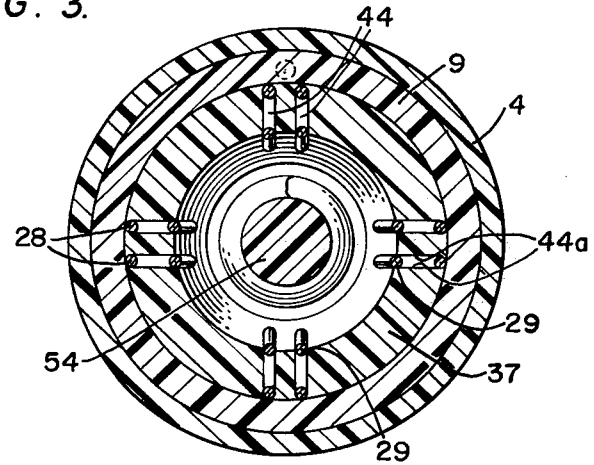
FIG. 3 is a transverse sectional view taken along the line 3—3 of FIG. 2.

The pin contacts 28 and 29 serve as the means to conduct electrical current intended to regulate 4 different circuits and in view of the intended use of the present switch, wherein low voltages and low current are involved it is preferable that relatively small dimensioned elements be used to complete the circuits and accordingly, the disclosed pin contacts are favored. The numerous pins 28 and 29 may be of any suitable construction, yet experience has shown that small diameter gold-plated wires are the most appropriate. The inherent flexibility or lack of radial stiffness or stability of such members in itself normally presents a problem as it will be appreciated that during radial deflection of such pin contacts during use of the switch, appropriate means must be provided to insure proper guiding and lateral stability thereof. Accordingly, a key component of the present switch is the pin contact guide member, generally designated 37, and which comprises a cylindrical member provided with a central web 38 having an inner surface 39 surrounding a relative large bore 40. Radiating outwardly from the web 38 are a plurality of ribs 41 each having an outer surface 42 providing a close sliding fit with the inner surface 27 of the guide sleeve side wall 9*a*. As shown in FIGS. 2, 3 and 5 the ribs 41 are spaced apart from one another to provide a plurality of radially extending slots 44 therebetween. All of the slots 44 are of a width providing a close sliding fit for the pin contacts 28 and 29 with each said slot serving to contain one each of the radially adjacent pin contacts 28 and 29. Accordingly, it will follow that there are a total of eight slots 44 with a pair of adjacent slots located in radial alignment with each of the lobes 12 of the opening 11 of the guide sleeve end wall 10. Additionally, it will be understood that the radially extending side walls 44*a* defining each slot 44 pass through the entire length of the guide member 37 from the central web 38 outwardly.

The outer surface 45 of the guide member web 38 is longitudinally aligned with the innermost portion of the holes 25 in the pin support member 22 and thus serves as the only structure of the guide member 37 resisting the inward radial displacement of the pin contacts 29.

The manner of assembly of various components described up to this point may be readily comprehended from a review of FIG. 2 of the drawings. Initially, the four pairs of contacts 28 and four pairs of contacts 29 are suitably anchored within the circuit plate or pin contact mount 30 after which the pin support member 22 containing the similarly located eight pairs of holes 25 and 26, is slipped over all of the pin contacts and moved into juxtaposition with the mount 30. At this point it will be understood that the rear or base portions of all of the pin contacts 28 and 29 are rigidly supported with the free ends or forward portions 28' and 29' of the respective contacts disposed in a position substantially forward of the wall 36 of the pin mount support member 22. Next, the pin contact guide member 37 is slipped over the end portions 28'-29' of the pin contacts and moved rearwardly until the rearward most portion of the web 38 and ribs 41 abut the forward wall 36 of the pin support member 22. When thusly assembled, one stationary pin contact 28 and displaceable pin contact 29 will be disposed within each one of the eight slots 44 as shown in FIGS. 2, 3 and 5 of the drawings and at this stage the additional switch components are ready to be introduced.

An actuator assembly, generally designated 46, is provided to offer means by which a user of the switch may selectively displace adjacent pairs of the displaceable wire contacts 29-29 in an outward radial direction until their free end portions 29'-29' abut the periphery of the free end portions 28'-28' of the stationary pin contacts. Before the mounting of the actuator assembly 46, which is shown most clearly in FIG. 2 of the drawings, it will be appreciated that the four pairs of displaceable pin contacts 29 as well as the four pairs of stationary pin contacts 28 are all disposed substantially parallel to one another and in a longitudinally straight manner since the holes 25 and 26 in the pin support member 22 are straight and parallel to one another and the slots 44 in the pin contact guide member 37 do not offer any surface which would deflect the forward most portions of the pin contacts out of a straight or axial alignment.

The actuator assembly 46 includes a longitudinal actuator rod 47 provided at its outer end with an appropriate knob 48 while its other end is threaded as at 49. These threads 49 cooperate with a threaded bore 50 formed in the central portion of the actuator contactor 51 comprising in turn, a circular rim 52 joined to a central hub 53. Projecting rearwardly from this hub 53 is a threaded stem 54 serving as a mount or support for the forward end of an actuator spring 55. The rearward end of the spring 55 will be seen to be attached within the threaded bore 56 in the central portion of the pin support member 22.

When the actuator assembly 46 is attached to the balance of the switch structure as shown in FIG. 2 of the drawings it will be noted that the rearmost surface 54' of the stem 54 is spaced axially well away from the forward wall 36 of the pin support member 22 such that at least a portion of the convolutions of the actuator spring 55 are freely disposed without engaging either the contactor stem 54 or pin support member 22. With this relationship in mind, it will follow that a radial wobble action may be imparted to the actuator assembly to displace the rod 47 and contactor 51 from the axial full-line position as shown in FIG. 2, to a deflected position such as shown in the broken lines in FIG. 2. The rigidity of the material comprising the actuator spring 55 will be understood to be selected in order to provide sufficient stiffness to insure that the actuator assembly 46 normally remains in the axially aligned full-line position of FIG. 2 while the obvious leverage afforded by the length of the rod 47 and knob 48 will readily allow of the aforedescribed radial displacement thereof against the force of the spring 55.

During the assembly of the actuator assembly 46 to the pin support member 22 it will be appreciated that the displaceable pin contacts 29 will all be radially deflected outwardly as the tapered periphery 57 of the circular rim 52 engages the inner surface of the free end portions 29' thereof. The foregoing occurs by providing a diameter to the actuator contactor 51 which is slightly greater than the diameter of the outer surface 45 of the web 38 of the pin contact guide member 37 and thus insures that a constant radial tension is at all times being applied to all of the displaceable pin contacts 29 regardless of the radial deflection of the contactor 51. The free end portions 29' of the displaceable contacts 29 are preferably slightly bent inwardly as shown in FIGS. 2 and 5 of the drawings thereby insuring surface-to-surface engagement when each pair of displaceable contacts 29 are urged into abutment with the outwardly adjacent pairs of stationary pin contacts 28, as shown in broken lines in the lower portion of FIG. 2. This arrangement is preferable to having the relatively sharp end edge of the displaceable contacts engaging the peripheral surface of the stationary contacts for obvious reasons.

Following attachment of the actuator assembly 46 to the pin support member 22 as above described, the guide sleeve 9 is slipped over the outer periphery of the pin contact guide member 37 and angularly aligned therewith by insertion of its pin 15 into the recess 35 of the pin support member 22, after which the seal element 18 is disposed in overlying relationship to the guide sleeve end wall 10 and oriented therewith by means of its hole 21. Thereafter the shell 2 is slipped over the outer periphery 24 of the guide sleeve 9. The attachment of the guide sleeve 9 provides an inner surface 27 which serves to support the entire outer periphery of the forward portion of all of the stationary pin contacts 28 and thus precludes any outward radial displacement thereof so that when the actuator assembly 46 is operated as previously described, the stationary contacts 28 are immobile and remain thusly even when the respective pairs of displaceable contacts 29 engage same.

The remaining structure of the switch 1 comprises the plug assembly, generally designated 3. This assembly may include components assuming various configurations according to the intended application of the switch 1 and a representative construction is shown in the accompanying drawings where, a plurality of plug elements 58 project rearwardly from the base 34 of the plug assembly. As previously described, the pin mount 30 may include appropriate printed circuits (not shown) on its rear surface 32 or any other suitable means for electrically connecting respective distal portions 33 of the various pin contacts 28 and 29 with selective ones of the plug elements 58, according to the intended function of the four actuating modes of the switch.

The plug assembly base 34 and its plug elements 58 may be retained in assembly with the balance of the switch by an appropriate plug cup, generally designated 59 and including an apertured base 60 surrounding plug elements 58 and including a skirt 61 masking the extent of the exposed plug elements 58. A forwardly directed flange 62 extending from the plug assembly base 60 is disposed intermediate the peripheral body sleeve 4 of the shell 2 and the base 34, pin mount 30 and pin support member 22. To provide a resilient snap fit attachment of the plug assembly 3 and thus the entire switch, to a mating female receptable (not shown), the skirt of the plug assembly is slotted as at 62 and includes on the inner periphery thereof, a circumferential groove 63.

In consideration of the foregoing structure it will be quite apparent that a unique switch assembly is provided due primarily to the novel construction and disposition of the dielectric contactor 51 disposed with the confines of the interior 8 and surrounded by the radially adjacently disposed stationary and displaceable contacts 28 and 29. An important feature facilitating the operation of the present invention includes the formation of the inner surfaces 41' of the ribs 41 in an inclined manner whereby these surfaces taper outwardly from the guide member web 38 such that a conically shaped cavity 8 is formed which substantially surrounds the contactor 51. This construction serves more that one purpose. When the displaceable wire contacts 29 are in the normal position and the actuator rod 47 is in the neutral position, a substantial portion of the free ends 29' of the displaceable contacts 29 will be seen to be freely disposed within the interior of the conical cavity 8 yet when the contacts 29 are displaced as shown in the lower portion of FIG. 2 of the drawings, a steadily increasing length of the contacts 29 become progressively disposed within the slots 44 below the guide member inner surface 41'. This action insures a progressively increasing amount of lateral support for the distal portion of the displaceable contacts 29 as they are laterally displaced and increasingly tensioned. Additionally, the conical configuration of the cavity or interior 8 allows of the combined radial and arcuate displacement of the actuator contactor 51.

The actuator spring 55 obviously serves as effective means for supporting and automatically returning the rod 47 to its neutral position but also offers a shock absorbing feature should the user continue to exert excessive lateral force upon the knob 48 after the tapered peripheral portion 57 of the contactor rim 52 has been radially displaced to the broken line position of FIG. 2 of the drawings, and should one continue to apply radial movement to the knob 48, either the end portion of the switch shell 2 or the end wall 10 of the guide sleeve 9 will serve as a fulcrum for the actuator rod 47 while the rear-most portion 54' of the contactor 51 will be displaced in an opposite or upward direction until the unsupported medial portion of the spring 55 engages the upper portion of the guide member web 38. The electrical integrity of the switch is additionally maintained if one were to apply excessive axial force to the rod 47. The size of the wire forming the spring 55 is selected to preclude damage thereto should an unusual axial pushing force be applied to the rod 47 while a pulling axial force on the rod will tend to slightly open those convolutions of the spring 55 intermediate the contactor 51 and pin support member 22 until the forward face of the contactor 51 abuts the rearward surface of the guide sleeve end wall 10.

I claim:

1. A multi-position switch including, a shell having a central throat in a front end, a support member within the opposite rear end of said shell, a plurality of stationary contacts disposed longitudinally within said shell, a plurality of displaceable contacts spaced adjacent and radially inwardly of said stationary contacts, said stationary and displaceable contacts having base portions fixedly disposed in said support member whereby the opposite free end portions of said radially adjacent contacts are normally maintained in a spaced apart manner, a guide member axially adjacent said support member and provided with a plurality of substantially radially extending slots throughout its length, portions of radially adjacent pairs of said stationary and displaceable contacts disposed within each one of said slots, an actuator rod disposed through said throat and having a contactor within said shell encircled by said displaceable contact free end portions whereby, radial deflection of said rod radially deflects said contactor to radially shift selected ones of said displaceable contacts into abutting engagement with said stationary contact disposed in the same said slot.

2. A switch according to claim 1 including, rigid means encircling the outer periphery of said guide member, and said stationary contacts abut said rigid means.

3. A switch according to claim 1 wherein, said displaceable contacts are of resilient wire.

4. A switch according to claim 1 wherein, all said contacts are of resilient wire.

5. A switch according to claim 1 wherein, said guide member includes a central web and said slots radiate outwardly therefrom.

6. A switch according to claim 1 wherein, said guide member and contactor are of dielectric composition.

7. A switch according to claim 1 wherein, said shell and guide member are cylindrical in cross-section, a guide sleeve intermediate said shell and guide member, said guide sleeve having an end wall partially restricting said throat and provided with a lobed opening defining the limits of said deflection of said rod.

8. A switch according to claim 1 including, spring means mounting the rear end portion of said actuator rod contactor to said support member, and said spring means normally maintaining said rod centrally disposed relative said throat.

9. A switch according to claim 1 including, a plug assembly attached to said shell rear end, said assembly including a base juxtaposed said contact base portions and a plurality of plugs axially extending from said plug assembly base.

10. A switch according to claim 1 wherein, said contactor includes a cylindrical periphery tapered toward said support member.

11. A switch according to claim 1 wherein, said stationary and displaceable contacts are adjacently disposed in pairs whereby, when said rod is deflected, two said displaceable contacts are simultaneously radially deflected into engagement with two said stationary contacts.

12. A switch according to claim 7 including, orientation means between said guide sleeve and both said support member and shell to insure angular alignment therebetween.

* * * * *